United States Patent [19]

Sternberg

[11] 4,052,146

[45] Oct. 4, 1977

[54] EXTRUSION PACK FOR SHEATH-CORE FILAMENTS

[75] Inventor: Ernest M. Sternberg, Chapel Hill, N.C.

[73] Assignee: Monsanto Company, St. Louis, Mo.

[21] Appl. No.: 745,333

[22] Filed: Nov. 26, 1976

[51] Int. Cl.[2] ..... D01D 3/00

[52] U.S. Cl. ..... 425/463; 425/131.5

[58] Field of Search ..... 425/131.5, 463; 264/171

[56] References Cited

U.S. PATENT DOCUMENTS

| | | | |
|---|---|---|---|
| 3,017,686 | 1/1962 | Breen et al. | 425/131.5 X |
| 3,669,591 | 6/1972 | Fermi et al. | 425/131.5 |
| 3,787,162 | 1/1974 | Cheetham | 425/463 |
| 3,992,499 | 11/1976 | Lee | 264/171 X |

*Primary Examiner*—Robert D. Baldwin
*Attorney, Agent, or Firm*—Donald J. Fitzpatrick

[57] ABSTRACT

An extrusion pack for the production of sheath-core filaments having a high filament density. The pack comprises a stacked assemblage of a stream proportioning means, a stream conjugating means and a spinneret means. The stream conjugating means having upper and lower chambers for forming the sheath-core filaments. The location and spacing of these chambers providing a high filament density.

8 Claims, 5 Drawing Figures

EXTRUSION PACK FOR SHEATH-CORE FILAMENTS

BACKGROUND OF THE INVENTION

1. Field of the Invention

This invention relates generally to an apparatus for the production of bicomponent filaments, and more particularly to an improved extrusion pack for producing large numbers of sheath-core filaments per unit area.

2. DESCRIPTION OF THE INVENTION

Filaments consisting of two or more components are well known in the art and are generally produced by coextruding the different components from extrusion packs having internal stream splitting and conjugating channels. Providing a network of channels in an extrustion pack for bicomponent spinning results in an apparatus that has a substantially lower production rate than a pack used for conventional single component spinning. This is attributed to fewer extrusion holes per unit area in bicomponent spinning packs than are provided in conventional packs. Providing an accurately machined extrusion pack that has stream splitting channels and conjugating passageways for forming the bicomponent filaments has resulted in slow, inefficient production rates. Filament density of sheath-core filaments as measured by the number of filaments extruded per unit area of extrusion pack is substantially lower than the filament density of single component filaments.

SUMMARY OF THE INVENTION

In accordance with my invention, as hereinafter more fully described, I provide an apparatus for extruding sheath-core filaments with a significantly higher filament density per unit area. This apparatus thus achieves higher rates of production than heretofore prior art extrusion packs.

The apparatus of this invention comprises three principal components arranged in a stacked assemblege: a stream proportioning means, a stream conjugating means and a spinneret means. These components are arranged and function in the following manner:

the stream proportioning means having first supply channels for receiving and discharging a first polymer to form sheaths and second supply channels for receiving and discharging a second polymer to form cores;

the stream conjugating means positioned adjacent to the stream proportioning means has upper and lower chambers, the upper chambers are connected to the first supply channels, contained within the chambers are sheath forming channels defined by the juncture of this element and the stream proportioning means, these channels are connected to the second supply channels to receive core polymer and to the chambers so that sheath polymer can flow and encapsulate the core polymer and essentially vertically aligned stream discharge passages connected to the sheath forming channels, the lower chambers have essentially vertically aligned sheath passages connected to the first supply channels, contained within these chambers are sheath forming channels defined by the juncture of this element and the spinneret means, these channels are connected to essentially vertically aligned core passages for receiving core polymer and to the chambers so that sheath polymer can flow and encapsulate the core polymer; and the spinneret means has essentially vertically aligned stream discharge passages connected to the sheath forming channels.

It is an object of this invention to provide an apparatus for forming sheath-core filaments having a high filament density per unit area.

DETAILED DESCRIPTION OF THE PREFERRED EMBODIMENT

Figure 1:
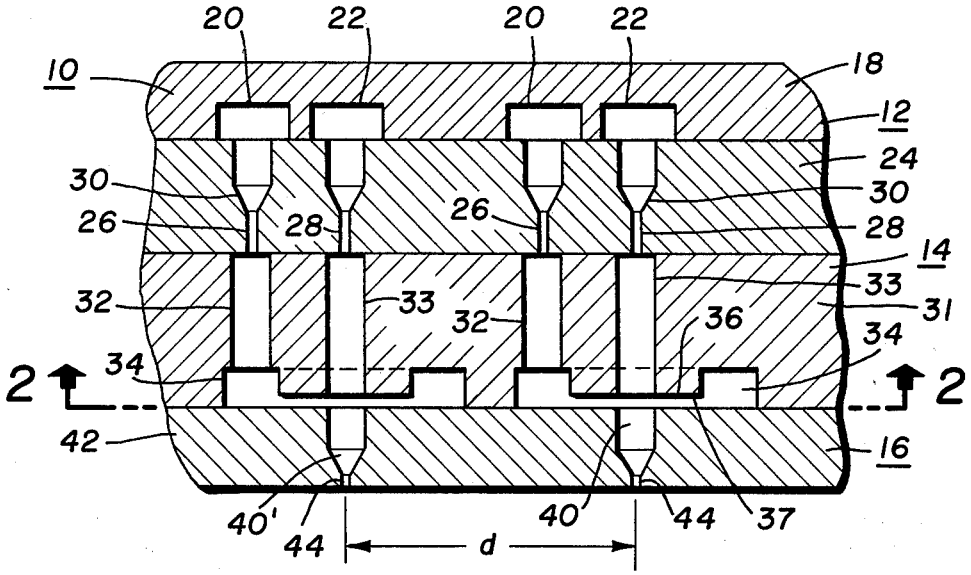
PRIOR ART FIG. 1.
FIG. 1 is a sectional view of an extrusion pack of the prior art.
Figure 2:
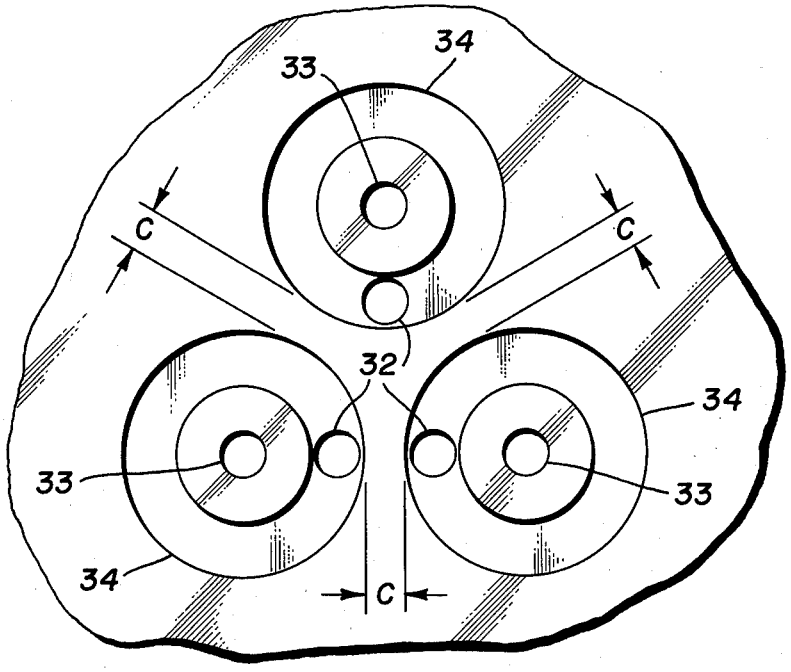
PRIOR ART FIG. 2.
FIG. 2 is a view taken along line 2—2 of FIG. 1.

FIGS. 1 and 2 illustrate extrusion packs of the prior art. Referring to FIG. 1 there is shown an extrusion pack 10 for the production of sheathcore filaments comprising the following principal elements arranged in a stacked assemblege; a stream proportioning means 12, a stream conjugating means 14 and a spinneret means 16.

Stream proportioning means 12 comprises a plate or disc 18 having first supply channels 20 for receiving and discharging a first polymeric material to form sheaths and second supply channels 22 for receiving and discharging a second polymeric material to form cores. Supply channels 20 and 22 can be a series of concentric cavities positioned within plate 18. A metering plate 24 is positioned adjacent plate 18 and contains essentially vertical meter passages 26 and 28. Polymer is discharged from channels 20 and passes into sheath meter passages 26 and polymer is discharged from channels 22 and passes into core meter passages 28. The metering passages may be constricted at 30 to equalize the rate of polymer discharge from the supply channels.

Stream conjugating means 14 is positioned adjacent metering plate 18. A plate or disc 31 is provided with sheath passages 32 and core passages 33. On the bottom surface of plate 18 are chambers 34, each having a centrally positioned channel 36. Sheath polymer passes through meter passage 26 into sheath passage 32 and into chamber 34. Core polymer passes from meter passage 28 and into core passage 33. The sheath polymer then fills chamber 34, flows radially through channel 36 connected at 37 toward the downwardly descending core polymer and encapsulating it thereby forming a sheath-core stream 40. The two polymers continue in a sheath-core configuration and are discharged as hereinafter described.

Positioned adjacent stream conjugating means 14 is spinneret means 16. A plate 42 is provided with a plurality of cappillaries 44 in alignment with core passages 33 to withdraw the thus formed sheath-core streams 40. A similar arrangement of stream proportioning means, stream conjugating means, and spinneret means is placed adjacent the heretofore described apparatus and also produces a sheath-core stream 40'. The spacing between these streams is shown as distance d.

Figure 3:
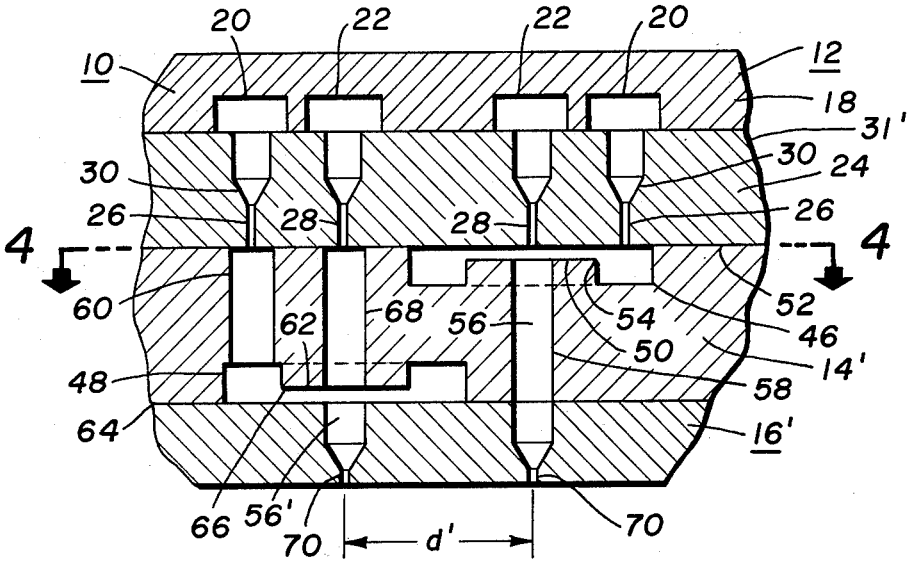
FIG. 3 is a sectional view of an extrusion pack of the instant invention.

The apparatus of the instant invention is shown in FIG. 3. In a like manner this extrusion pack consists of three principal elements arranged in a stacked assemblege; a stream proportioning means 12, a stream conjugating means 14' and a spinneret means 16'. Stream proportioning means 12 is constructed in a manner previously described. Metering plate 24 may optionally be provided, however, the utilization of this element is not essential to the formation of the sheath-core filament.

Polymer may be discharged directly from the supply channels 20, 22 to the stream conjugating means 14'. If a metering plate is used, however, it is provided with sheath meter passages 26 connected in an essentially vertical alignment with first supply channels 20 and core meter passages 28 connected in a like manner to second supply channels 22. The metering passages may be constricted at 30 to equalize the rate of polymer discharge from the supply channels.

Positioned adjacent the stream proportioning means is stream conjugating means 14'. A plate or disc 31' is provided with at least one upper chamber 46 and at least one lower chamber 48. The upper chamber is connected to first supply channel 20 and receives sheath polymer via sheath meter passage 26. Contained within chamber 46 is sheath forming channel 50 defined by the juncture 52 of the stream proportioning means 12 and stream conjugating means 14'. This channel is connected at 54 to chamber 46. Core polymer flows from the second supply channel 22 through core meter passage 28. A sheath-core stream 56 is formed when the polymers are combined. A column of core polymer is encapsulated by sheath polymer that flows radially from chamber 46 into channel 50. The thus formed sheath-core stream 56 enters as essentially vertically aligned stream discharge passage 58. Chamber 46 and passages 28 and 58 can be in coaxial alignment thus forming concentric sheath-core streams or these elements may be offset or in eccentric alignment, thus forming eccentric sheath-core streams. Filaments obtained from such eccentric streams are thus capable of being crimped. Lower chamber 48 has essentially vertically aligned sheath passage 60 for receiving sheath polymer from first supply channel 20 via connecting sheath meter passage 26. Contained within the chamber is sheath forming channel 62 defined by the juncture 64 of the stream conjugating means 14' and spinneret means 16'. This channel is connected at 66 to chamber 48. Core polymer flows from the second supply channel 22 through core meter passage 28 into an essentially vertically aligned core passage 68. A sheath-core stream 56' is formed when the polymers are combined in a manner as hereinbefore described. The thus formed sheath-core streams 56 and 56' are discharged from the stream conjugating means 14' into spinneret means 16'. The spinneret contains a series of capillaries 70 in an essentially vertical alignment with passages 58 and 68.

Chambers 46 and 48 can be toroidal. It has been found that this particular shape offers the optimum flow of polymer from the chamber into the sheath-core forming region.

Figure 4:
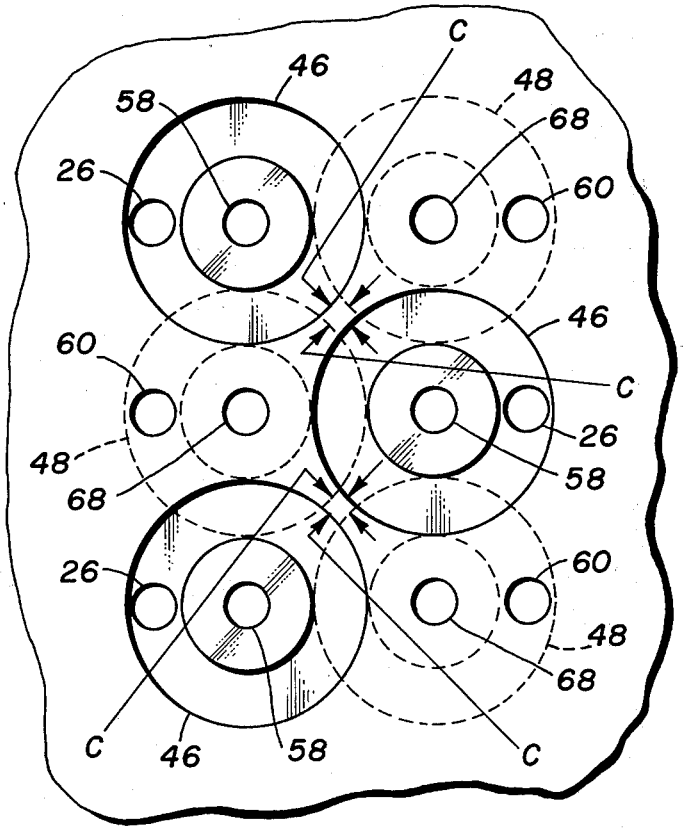
FIG. 4 is a view taken along line 4—4 of FIG. 3.

FIGS. 2 and 4 clearly show the advantages of this invention. The number of capillaries 44 that can be arranged on the spinneret plate 42 is determined by the diameter of chambers 34 and the desired spacing between these chambers. The arragement shown in FIG. 2 produces a filament density of 1.69 filaments per square cm of spinneret surface.

The filament density is increased by my invention as shown in FIG. 4 wherein the chambers 46 and 48 are arranged on two levels so that they partially overlap. Using the same chamber diameter as chambers 34 of FIG. 2 and clearance between chambers, filament density is increased to 2.93 filaments per square cm of spinneret surface, an increase of 74 percent. The clearance "C" between the chambers in the apparatus of FIGS. 2 and 4 is the same. In FIG. 1 the distance between streams 40 and 40' is represented by *d*, FIG. 3 shows the distance *d'* between streams 56 and 56' is substantially reduced. This is a further indication of the resultant increased filament density of my invention.

While FIG. 3 shows the conjugating chambers on two levels these chambers can be arranged on several levels. A series of plates or disc 31' can each be provided with conjugating chambers. Depending upon the dimensions of the supply channels and metering passages, the chambers can be placed in various overlapping arrangements. In this way the chambers of one plate or disc can partially overlap the chambers of an adjacent plate or disc.

Figure 5:
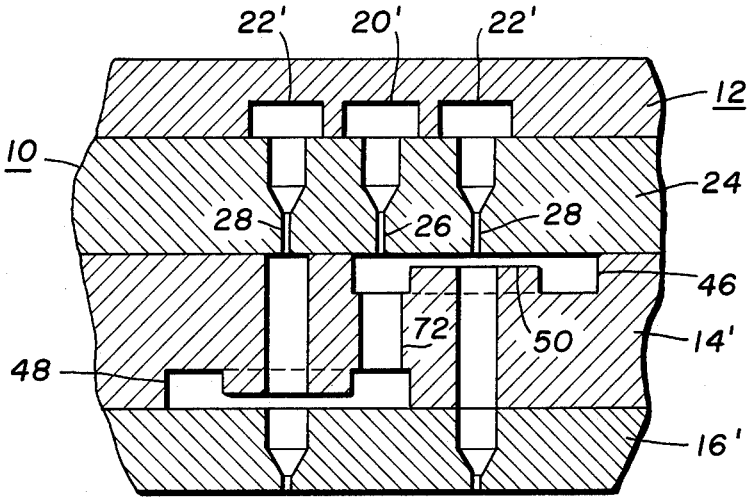
FIG. 5 is a sectional view showing another embodiment of an extrusion pack of the instant invention.

FIG. 5 shows another embodiment of the instant invention. In this embodiment first supply channel 20' feeds polymeric materials to form more than one sheath and second supply channels 22' receive and discharge a second polymeric material as hereinbefore discussed. A metering plate 24 having meter passages 26 and 28 is provided in a like manner as heretofore described. Stream conjugating means 14' has upper chamber 46 and lower chamber 48. The upper chamber is connected to first supply channel 20' and receives sheath polymer from sheath meter passages 26. The sheath polymer flows into channel 50 and into vertical distribution passage 72. Passage 72 connects upper chamber 46 to lower chamber 48 and supplies the lower chamber with sheath polymer. Core polymer is distributed to chambers 46 and 48 in a manner previously described. This embodiment uses one supply channel to feed sheath polymer to more than one chamber positioned within the stream conjugating means 14'.

It may, therefore, by seen that the invention described herein provides an apparatus for spinning sheath-core filaments having a high filament density.

Various modifications of the invention in addition to those shown and described herein will become apparent to those skilled in the art from the foregoing description and accompanying drawings. Such modifications are intended to fall within the scope of the appended claims.

I claim:

1. An extrustion pack for production of sheath-core filaments comprising:

a stacked assemblege of a stream proportioning means, a stream conjugating means, and a spinneret means;

said stream proportioning means having first supply channels for receiving and discharging a first polymer to form sheaths and second supply channels for receiving and discharging a second polymer to form cores;

said stream conjugating means positioned adjacent said stream proportioning means has means defining upper and lower chambers, said upper chambers are connected to certain of said first supply channels, contained within said upper chambers are upper sheath forming channels defined by the juncture of said stream conjugating means and said stream proportioning means, said upper sheath forming channels are connected to certain of said second supply channels so that sheath polymer can flow and encapsulate said core polymer, stream discharge passages essentially vertically aligned with said certain of said second supply channels and connected to said upper sheath forming channels, said lower chambers have sheath passages connected to certain other of said first supply channels, contained within said lower chambers are lower sheath forming channels defined by the juncture of said stream conjugating means and said spinneret means, said lower sheath forming channels are connected to core passages essentially vertically aligned with certain other of said second supply channels for receiving core polymer so that sheath polymer can flow and encapsulate said core polymer; and positioned adjacent said stream conjugating means is spinneret means having capillaries in communication and essentially vertically aligned with respective stream discharge passages and core passages.

2. The apparatus of claim 1 wherein said stream proportioning means further comprises a metering plate disposed between said proportioning means and said conjugating means having core meter passages and sheath meter passages in essentially vertical alignment with and connected to said second and first supply channels, respectively.

3. The apparatus of claim 1 wherein said conjugating means chambers are toroidal.

4. The apparatus of claim 2 wherein each said core meter passage, and its respective chamber and capillary are essentially in coaxial alignment.

5. The apparatus of claim 2, wherein each said core meter passage, said chambers, and said stream discharge passages are in eccentric alignment.

6. The apparatus of claim 1 wherein said upper chambers partially overlap said lower chambers.

7. The apparatus of claim 1 wherein said conjugating means is a pair of plates.

8. An extrustion pack for production of sheath-core filaments comprising: a stacked assemblege of a stream proportioning means, a stream conjugating means, and a spinneret means; said stream proportioning means having first supply channels for receiving and discharging a first polymer to form sheaths and second supply channels for receiving and discharging a second polymer to form cores;

said stream conjugating means positioned adjacent said stream proportioning means has means defining upper and lower chambers, said upper chambers are connected to said first supply channels, contained within said upper chambers are upper sheath forming channels defined by the juncture of said stream conjugating means and said stream proportioning means, said upper sheat forming channels are connected to certain of said second supply channels so that sheath polymer can flow and encapsulate said core polymer, stream discharge passages essentially vertically aligned with said cartain of said second supply channels and connected to said upper sheath forming channels, said lower chambers have sheath passages connected to said first supply channels, contained within said lower chambers are lower sheath forming channels defined by the juncture of said stream conjugating means and said spinneret means, said lower sheath forming channels are connected to core passages essentially vertically aligned with certain other of said second supply channels for receiving core polymer so that sheath polymer can flow and encapsulate said core polymer, each said upper chamber is in fluid communication with a respective lower chamber through a passage connected to both chambers; and positioned adjacent said stream conjugating means is spinneret means having capillaries in communication and essentially vertically aligned with respective stream discharge passages and core passages.

* * * * *